United States Patent [19]

Krasuski et al.

[11] Patent Number: 4,926,612

[45] Date of Patent: May 22, 1990

[54] MACHINE FOR INSERTING MAIL INTO ENVELOPES

[75] Inventors: Marek Krasuski, Fontenay Aux Roses; Bernard Prugnolle, Pantin, both of France

[73] Assignee: Societe Anonyme dite: ALCATEL SATMAN, Bagneux, France

[21] Appl. No.: 380,238

[22] Filed: Jul. 17, 1989

[30] Foreign Application Priority Data

Jul. 27, 1988 [FR] France ..... 8810121

[51] Int. Cl.[5] ..... B65B 43/26

[52] U.S. Cl. ..... 53/69; 53/266 A; 53/381 R

[58] Field of Search ..... 53/266 A, 206, 460, 53/569, 64, 69, 382, 387, 117, 116

[56] References Cited

U.S. PATENT DOCUMENTS 2,771,726 11/1956 Owen et al. ..... 53/266 A X
4,418,515 12/1983 Foster et al. ..... 53/460 X

FOREIGN PATENT DOCUMENTS 1237872 6/1971 United Kingdom .
2183214 6/1987 United Kingdom .

*Primary Examiner*—James F. Coan
*Attorney, Agent, or Firm*—Sughrue, Mion, Zinn, Macpeak & Seas

[57] ABSTRACT

The machine has a set of wheels and a set of backing wheels for bringing envelopes into a filling position where they face a mail path, and holding them therein, the mail path having mail advance means and envelope body opening fingers. The set of backing wheels (4) is coupled via a free wheel mechanism (26) to the mail advance means (8) and is controlled to leave a retracted position once an envelope is in a filling position to return to a position where it presses against the set of wheels (3) by means (17, 35–36) for detecting that an item of mail has been partially inserted into the envelope, and is stopped together with the mail advance means by means for detecting that the item of mail has been fully inserted into the envelope. The invention is applicable to processing mail.

8 Claims, 1 Drawing Sheet

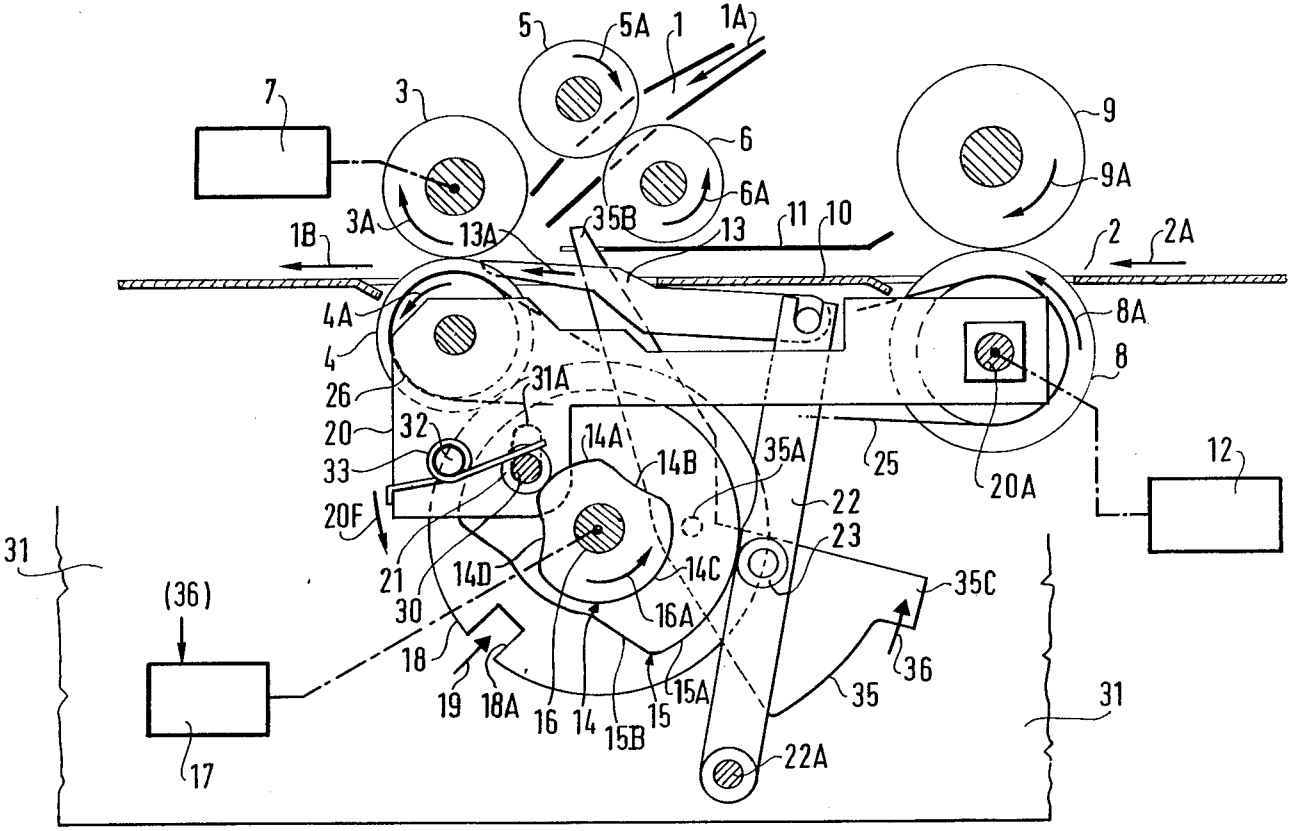
1A
1
5A
5
6
6A
13
35B
3
13A
3A
7
1B
10
11
9
9A
2
2A
8A
8
12
20A
25
4A
4
26
20
33
20F
32
31A
14A
14B
14C
14D
16A
16
15A
15
15B
14
21
30
18
18A
19
35C
36
35
22
23
35A
22A
31
(36)
17
31

MACHINE FOR INSERTING MAIL INTO ENVELOPES

The present invention relates to machines for inserting mail into envelopes.

BACKGROUND OF THE INVENTION

Such machines are already known. They are used as office machines for preparing mail for posting, or else they form a part of a larger installation for automatically processing large volumes of mail and further including a machine for folding and/or collating, and a machine for closing filled envelopes.

In machines for inserting mail into envelopes, empty envelopes are presented successively in a filling position facing a mail transfer path. Each envelope is held in this filling position throughout the time taken to insert the mail into the envelope. Means are mounted on an envelope path for bringing each empty envelope to the filling position and for holding it there. These means may include a set of wheels and an associated set of backing wheels pressing thereagainst, with the envelopes being received between the sets which are disposed at the end of the mail transfer path. When driven, the set of wheels and the set of pressure backing wheels contribute to bringing each envelope into its filling position by driving the envelope body until the join line between the envelope body and the previously folded-back flap is received therebetween. The set of wheels is then no longer driven, the envelope comes to rest, and is held in the filling position facing the mail transfer path.

Envelope body opening fingers are used to open the body of the envelope held in the filling position in order to facilitate inserting the mail. These fingers are mounted at the front of the filling position and are normally retracted. In order to insert mail, they are actuated into an envelope body opening position and penetrate partially into the envelope body. In addition, the above-mentioned set of backing wheels is advantageously retractably mounted facing the set of wheels, and is put into the retracted position as soon a the set of wheels is no longer driven in order to allow the fingers in the opening position to take effect.

In prior insertion machines, various specific mechanism have also performed the mail insertion operation per se. They are intended in particular to enable the mail to be inserted right down to the end of the envelope. An example of one such mechanism is described, in particular, in French patent application No. 84 14 141 filed by the present Applicant. This mechanism includes an insertion plate mounted as a carriage which is driven with reciprocating motion. The insertion plate receives the mail to be inserted from the mail transfer path, then penetrates together with the mail held thereby into the envelope, after which it withdraws from the envelope, releasing the mail which it has been previously accompanied to the far end of the envelope. The use of such a mechanism and its control means give rise to machines which are relatively bulky. They are often difficult to manufacture and assemble given that it is desirable to house them in as small a volume as possible in order to reduce the bulk of the overall machine as much as possible.

The object of the present invention is to enable mail to be fully inserted into envelopes using a mechanism which is very simple and which avoids the above-mentioned drawbacks of bulkiness and difficulty of assembly.

SUMMARY OF THE INVENTION

The present invention provides a machine for inserting mail into envelopes, the machine comprising:

a first set of wheels and an associated first set of backing wheels for bringing an envelope to a defined "filling" position and presenting it facing a mail path;

mail advance means on the mail path for advancing an item of mail towards the envelope in the filling position;

means for actuating the first set of backing wheels from a presser position to a retracted position when the envelope is in said filling position; and envelope body opening means controlled to move from a retracted position to an opening position when the envelope is in said filling position;

wherein said first set of backing wheels is coupled via a freewheel mechanism to said mail advance means in order to be driven therewith, said advance means themselves being mounted at a distance from said first set of backing wheels which is less than the length of the items of mail to be inserted in the envelopes; and wherein the machine also includes first detector means for detecting partial insertion of an item of mail into an envelope, said detection means being coupled to said means for actuating the first set of backing wheels to return them to their presser position, thereby ensuring that the item of mail is fully inserted into the envelope.

The mail advance means may include a pair of second sets of wheels pressing against each other mounted at the outlet from the mail path and coupled to the first sets of wheels and backing wheels by a fixed mail guide plate.

The first set of backing wheels may be carried by a pair of arms hinged to the axis of one of the second sets of wheels.

The pair of arms may carry a control spacer shaft resiliently bearing against a control cam having two profiles around its periphery centered substantially opposite each other for holding the first set of backing wheels in the presser position and alternatively with two second profiles for holding the first set of backing wheels in the retracted position.

BRIEF DESCRIPTION OF THE DRAWING

An embodiment of the invention is described by way of example with reference to the sole FIGURE of the accompanying drawing which is a fragmentary elevation view showing an insertion machine of the invention diagrammatically.

DETAILED DESCRIPTION

In this figure, reference 1 designates a path for empty envelopes to be filled and reference 2 designates a path for mail. Arrow 1A indicates the advance direction for reach envelope along the path 1, and arrow 2A indicates the advance direction for each item of mail along the path 2.

By advancing along the path 1, successive envelopes are presented in a defined filling position facing the mail path 2. A first set of wheels 3 and an associated first set of presser backing wheels 4 define the filling position at the end of the path 1. They are mounted facing the mail path 2. The first set of wheels 3 is rotated in the direction of arrow 3A, and together with its set of presser backing wheels 4 it serves to convey each envelope into its filling position. The first set of wheels 3 is stopped when the envelope arrives with the join line between its body and its flap (previously folded open) situated between the first set of wheels 3 and the first set of backing wheels 4. A second pair of sets of wheels 5 and 6, said sets pressing against each other, is situated upstream from the sets of wheels and backing wheels 3, 4 on the path 1 and serves to hold the previously folded open flap of the envelope. These sets of wheels and backing wheels 3, 4 and of upstream wheels 5 and 6 thus serve to present each envelope in the filling position and to hold it in this position during the filling operation.

A "envelope" motor 7 advances the envelopes along the path 1 until they reach the filling position. It drives the sets of wheels 3 and 5. After filling, it is used for ejecting each envelope.

The mail path 2 is fitted with its own means for advancing mail therealong. These mail advance means comprise, in particular, a third pair of sets of wheels 8 and 9 pressing against each other and situated at the outlet from the mail path 2. Resilient means (not shown) keep the set of wheels 8 pressing against the set of wheels 9.

This third pair of sets of wheels 8 and 9 is mounted at a distance from the sets of wheels and backing wheels 3, 4 which is less than the length of the items of mail. The sets of wheels 8 and 9 thus directly insert each item of mail some way into the envelope presented in the filling position. A fixed guide plate 10 is mounted between the set of wheels 8 and the set of backing wheels 4 in order to guide each item of mail while it is being inserted. A backing plate 11 between the set of wheels 9 and the set of wheels 3 is associated therewith.

The sets of wheels 8 and 9 are both shown as being driven. Arrows 8A and 9A show their directions of rotary drive. In a variant, only one of these sets of wheels is driven, in which case the bottom set of wheels 8 is the driven set. A "mail" motor 12 is coupled to the set of wheels 8, and optionally also to the set of wheels 9.

In order to insert an item of mail in an envelope presented in the filling position, the set of backing wheels 4 is mounted to be slightly retractable from the set of wheels 3. In addition, envelope body opening fingers 13 are associated with these sets of wheels and backing wheels 3 and 4. The fingers 13 are normally mounted in a retracted position ahead of the wheels and the backing wheels 3 and 4, beneath the mail guide plate 10. They are actuated in the direction of arrow 13A when the backing wheels 4 are retracted so as to occupy an opening position for penetrating between the wheels 3 and the backing wheels 4 into the body of the envelope.

A cam 14 is used for controlling the backing wheels 4 so as to move them between their position where they press against the wheels 3, and their retracted position. Another cam 15 is used for controlling the fingers 13 to move them between their retracted position ahead of the wheels 3 and backing wheels 4, and their opening position. These two cams are mounted on a common controlling drive shaft 16. The drive shaft is driven by its own stepper motor control circuit 17 in the direction of arrow 16A, and serves to advance the cams synchronously with the various stages of an insertion cycle.

A pair of pivotally mounted arms 20 serve to actuate the set of backing wheels 4 carried thereby. Each of these arms carries a cam-follower wheel 21 which bears against the cam 14. In similar manner, a pair of hinged levers 22 actuates the fingers 13. Each of these levers carries a cam-follower wheel 23 bearing against the cam 15. Each of these cams 14 and 15 is constituted by a pair of cams, one pair for the pair of arms 20 and the other for the pair of levels 22. The hinge axis of the arms 20 is referenced 20A and the hinge axis of the levers 22 is referenced 22A.

In the embodiment of the invention, the set of backing wheels 4 is coupled to the set of mail advance wheels 8. A belt transmission 25 (sketched in lightly to avoid overcrowding the figure) couples the set of wheels 8 to a freewheel mechanical 26 mounted on the shaft for the set of backing wheels 4. Tensioning wheels (not shown) are associated with the belt 25 in order to keep it at constant tension, regardless of whether the set of backing wheels 4 is in its retracted position or in its pressure-applying position against the set of wheels 3. Arrow 4A shows the rotary drive applied to the set of backing wheels 4, either by friction against the set of driven wheels 3, or else by coupling to the set of wheels 8.

In addition, the pair of arms 20 carrying the set of backing wheels 4 has its hinge axis 20A directly defined by the shaft of the mail advance set of wheels 8. This pair of arms 20 extends laterally on either side of the mail guide plate 10. It couples the set of backing wheels 4 mechanically with the set of mail advance wheels, with the backing wheels pivoting about the axis of the mail advance wheels.

At its opposite end from the axis 20A, each arm 20 has a terminal shoulder which is not referenced. A control shaft 30 is mounted as a spacer shaft between the pair of arms 20 and passes through the shoulder of each of them. This shaft 30 extends beyond side plates of the machine such as side plate 31. At each of its ends, this shaft carries the abovementioned wheel 21 bearing against a cam 14. A substantially vertical small window 31A is provided in each of the end plates 31 in order to enable the control shaft 30 to slide when it receives control motion from the cam 14. Arrow 20F represents the pivoting of the pair of arms 20 about its hinge axis 20A.

The control shaft 30 is resiliently urged towards its low position in the envelope 31A to press the wheels 21 against the cams 14. To this end, each of the arms 20 has a projecting finger 32 extending transversely to its shoulder and in the proximity of the window 31A through which the shaft 30 slides. A hairpin spring 33 is mounted on the finger 22 having a terminal length which constitutes a thrust abutment against the control shaft 30 while its opposite other terminal length is fixed to the edge of the support arm 20.

This spring thus keeps the wheel 21 pressed against the cam 14, and also keeps resilient pressure between the set of backing wheels 4 and the set of wheels 3, thereby making allowance for items of mail having different thicknesses.

With respect to the mechanical coupling and the drive coupling between the set of backing wheels 4 and the set of mail advance wheels 8, the periphery of the cam 14 has two profiles 14A and 14C centered substantially opposite each other for putting the set of backing wheels 4 into the presser position and for maintaining it there, with these profiles alternating with two other profiles 14B and 14C for putting the set of backing wheels 4 into the retracted position and maintaining it there. In comparison, the periphery of the cam 15 has only one profile 15A for putting the fingers 13 into the retracted position and one other profile 15B for putting the fingers 13 into the opening position.

These profiles on the cams 14 and 15 extend over specific angular sectors depending on the control effects they are to have. Each of the profiles 14A, 14B, and 14D corresponds to an angular sector of 60°, whereas the profile 14C extends over an angle of close to 180°. Profile 15A extends over an angular sector of close to 240° and profile 14B over a sector close to 120°. In addition, these cams are positioned relative to each other so that the wheel 21 begins making contact with profile 14A when the wheel 23 is situated substantially three quarters of the way along the profile 15A. With the cams in this relative position, as shown, the drive shaft 16 is in a reference or "rest" position. This position is flagged by a disk 18 having a notch 18A associated with a detector mounted as an optical sender/receiver fork and indicated at 19. The detector 19 serves to stop drive being applied to the shaft 16 and the cams 14 and 15.

A detecting lever 35 is used for detecting each item of mail while it is being inserted. This lever is hinged about an axis 35A. One of its ends 35B passes through the guide plate 10 to constitute an obstacle in front of the set of wheels 3 and the set of backing wheels 4. Its opposite end 35C forms a detector flag. An optical detector represented by 36 detects the flag 35 and indicates whether or not an item of mail is being inserted beneath its end 35B. By detecting the presence or absence of an item of mail in this way, the detector assembly 35 and 36 serves to determine the instant at which the item has been partially inserted into the envelope, given the known rate of advance of the item of mail, followed by the instant at which it has been fully inserted. This instant at which the item of mail has been fully inserted is preferably signalled by the end 35B of the lever 35 returning to its obstacle position, with this return still being detected by the flag 35C and the detector 36. This detector assembly 35-36 controls the circuit 35 and also controls the mail motor 12, via a selected time delay or via an up/down counter (not shown) for counting unit advance displacements of the time of mail with the counter being triggered by the detector detecting the item of mail, thereby ensuring that the motor 12 is stopped when the item of mail is fully inserted into the envelope.

In operation, the drive shaft 16 for the cams 14 and 15 is rotated from its rest position as given by the disk 18 and its associated detector 19, whenever an envelope advances towards the filling position. Once the envelope has reached the filling position, the motor 7 is stopped and the envelope is thus held for insertion of an item of mail. During the time required for the envelope to take up the filling position, and for a short time thereafter, the wheel 21 rests on profile 14A while the wheel 23 is on profile 15A. As soon as the envelope is in the filling position, the wheel 21 moves onto profile 14B and the wheel 23 onto profile 15B. The profile 14B causes the set of backing wheels 4 to take up the retracted position, while the profile 15B causes the fingers 13 to take up the envelope body opening position.

The mail motor 12 is driven, after an appropriate time delay, once the envelope has reached the filling position. It advances an item of mail along the path 2 upstream from the set of wheels 8 and 9, and then the item of mail is caused to advance by the set of wheels 8 and 9 onto the guide plate 10 so as to go between the wheels 3 and the backing wheels 4, and thus into the envelope. During this advance, the wheel 21 rests against profile 14B: the backing wheels 4 are driven together with the advance wheels 8, but they are in the retracted position; they therefore have no effect on the mail.

Once the time of mail is partially engaged in the envelope and has practically or totally escaped from the mail advancing wheels 8 and 9, the wheel 21 moves onto profile 14C and the backing wheels 4 take up the presser position. These driven backing wheels 4 thus ensure that filling continues until the envelope is completely filled.

While the mail is advanced on the guide plate 10, the detector assembly 35, 36 detects the presence of mail being inserted. From this detection instant, the control circuit 17 determines the instant when the item of mail is partially inserted into the envelope. The detector assembly 35, 36 also serves to stop the motor 12 when the mail is fully inserted into the envelope, thereby stopping the backing wheels 4.

Once the mail has been fully inserted into the envelope and the mail motor 12 has stopped, the filled envelope is ejected along the direction of arrow 1B by switching back on the envelope motor 7 while the profile 14C continues to keep the set of backing wheels 4 in the presser position.

While the filled envelope is being ejected, the wheel 21 passes over the profile 14D and the set of backing wheels 4 returns to the retracted position. This allows the filled envelope to be processed while it is being ejected, so that each envelope can be driven in the reverse direction, i.e. in the opposite direction to arrow 1B, in which case the set of backing wheels 4 should have no effect. After such processing, the filled envelope is again driven in the direction of arrow 1B and the wheel 21 passes onto profile 14A in order to return the set of backing wheels to the presser position.

The control circuit 17 for the shaft 16 having a controlled stepper motor serves to ensure that the cams advance synchronously with with the various stages of the insertion cycle. When the shaft 16 returns to its reference position, as detected by the detector 19, it is again stopped. It is driven through one more full turn for each new insertion cycle.

The essential advantages of this insertion machine of the present invention lie in the simplicity of the insertion mechanism and of its control, the ease with which they can be assembled, and the very small amount of space they occupy. In addition, the mechanism and its control are very robust and they operate reliably. The mechanism has low inertia.

We claim:

1. A machine for inserting mail into envelopes, the machine comprising:

a first set of wheels and an associated first set of backing wheels for bringing an envelope to a defined "filling" position and presenting it facing a mail path;

mail advance means on the mail path for advancing an item of mail towards the envelope in the filling position;

means for actuating the first set of backing wheels from a presser position to a retracted position when the envelope is in said filling position; and envelope body opening means controlled to move from a retracted position to an opening position when the envelope is in said filling position;

wherein said first set of backing wheels is coupled via a freewheel mechanism to said mail advance means in order to be driven therewith, said advance means themselves being mounted at a distance from said first set of backing wheels which is less than the length of the items of mail to be inserted in the envelopes; and wherein the machine also includes first detector means for detecting partial insertion of an item of mail into an envelope, said detection means being coupled to said means for actuating the first set of backing wheels to return them to their presser position, thereby ensuring that the item of mail is fully inserted into the envelope.

2. A machine according to claim 1, further including second detection means for detecting that an item of mail has been fully inserted into an envelope and coupled to said advance means in order to stop their drive and stop the drive to the first set of backing wheels.

3. A machine according to claim 2, wherein said advance means include a pair of second sets of presser wheels mounted on the outlet from the mail path, with at least one of said sets being coupled to a mail motor, and wherein it further includes a fixed mail guide plate between said first sets of wheels and backing wheels and said second set of wheels.

4. A machine according to claim 3, wherein said means for actuating the first set of backing wheels include a pair of arms carrying said set of backing wheels and hinged about the axis of one of the second sets of wheels.

5. A machine according to claim 4, wherein said means for actuating the first set of backing wheels further includes a cam whose periphery has two first substantially opposite control profiles for putting the first set of backing wheels into the presser position, alternating with two second control profiles for putting the first set of backing wheels into the retracted position, one of said first profiles being used for keeping the first set of backing wheels in the presser position from said partial insertion of the item of mail into the envelope at least until it is fully inserted into the envelope.

6. A machine according to claim 5, wherein said first and second detection means for detecting partial and full insertion of an item of mail into an envelope comprise a detection lever constituting an obstacle which is retractable by the item of mail while it is being inserted via said guide plate and in front of said first and second sets of wheels and backing wheels, and an associated optical detector coupled to a control circuit for controlling said cam and, via a time delay circuit, to said mail motor for putting the first set of backing wheels into the presser position as soon as partial insertion occurs, and for stopping the mail motor as soon as full insertion has been achieved.

7. A machine according to claim 5, wherein said pair of arms carries a control shaft mounted as a spacer shaft between said arms, with each of its ends supporting a respective cam follower wheel engaging said cam.

8. A machine according to claim 7, wherein said control shaft is urged resiliently towards said cam by a hairpin spring carried by said arms having one of its terminal arms constituting a thrust abutment on said control shaft.

* * * * *